US006374904B1

(12) United States Patent
Hurst

(10) Patent No.: US 6,374,904 B1
(45) Date of Patent: Apr. 23, 2002

(54) HEAT EXCHANGER AND CHANNEL MEMBER THEREFOR

(76) Inventor: Geoff Hurst, 50 Bolwarra Avenue, Pymble, NSW 2073 (AU)

( * ) Notice: Subject to any disclaimer, the term of this patent is extended or adjusted under 35 U.S.C. 154(b) by 0 days.

(21) Appl. No.: 09/493,107

(22) Filed: Jan. 28, 2000

(51) Int. Cl.[7] ..... F28F 3/12
(52) U.S. Cl. ..... 165/78; 165/166
(58) Field of Search ..... 165/166, 165, 165/78; 29/890.039

(56) References Cited

U.S. PATENT DOCUMENTS

| | | | | | |
|---|---|---|---|---|---|
| 1,750,850 | A | * | 3/1930 | Mantle et al. | 165/166 X |
| 3,460,611 | A | * | 8/1969 | Folsom et al. | 165/166 |
| 4,386,651 | A | * | 6/1983 | Reinhard | 165/166 X |
| 4,475,589 | A | * | 10/1984 | Mizuno et al. | 165/166 |
| 4,665,974 | A | * | 5/1987 | Grehier et al. | 165/166 X |
| 4,805,695 | A | * | 2/1989 | Ishikawa et al. | 165/166 |
| 4,976,313 | A | * | 12/1990 | Dahlgren et al. | 165/166 X |
| 5,072,790 | A | * | 12/1991 | Lapowsky | 165/166 |
| 5,078,208 | A | * | 1/1992 | Urch | 165/166 |

FOREIGN PATENT DOCUMENTS

| | | | | |
|---|---|---|---|---|
| AU | 571445 | | 1/1984 | |
| GB | 938088 | * | 9/1963 | 165/166 |
| GB | 2160634 | * | 12/1985 | 165/166 |
| JP | 56-12995 | * | 2/1981 | 165/166 |
| SE | 153006 | * | 1/1956 | 165/166 |
| SU | 512362 | * | 6/1976 | 165/166 |

* cited by examiner

*Primary Examiner*—Leonard Leo
(74) *Attorney, Agent, or Firm*—Leydig, Voit, & Mayer, Ltd.

(57) ABSTRACT

A heat exchanger includes a housing extending between a first end and a second end and having a first housing opening and a second opening disposed proximate the first end. The housing has a third housing opening and a fourth housing opening disposed proximate the second end.

22 Claims, 19 Drawing Sheets

HEAT EXCHANGER AND CHANNEL MEMBER THEREFOR

FIELD OF THE INVENTION

The present invention relates to a heat exchanger and also to a channel member for a heat exchanger.

The invention has been developed primarily for use with air conditioning heat exchangers and will be described hereinafter with reference to that application. It will be appreciated, however, that the invention is not limited to that particular field of use and is also applicable to other heat exchangers and heat transfer between fluids other than air.

BACKGROUND ART

Known heat exchangers generally include two separate fluid flow paths which are adjacent to each other such that heat can be transferred from one path to the other. When such heat exchanges are configured for use in large multi-storey building they are bulky and/or expensive to manufacture. This is in part due to the required capacity, complex manufacturing techniques and/or the materials from which the exchanger is produced. Additional difficulties are introduced by the requirement to seal each fluid flow path from each other, while maintaining acceptable thermal transfer properties.

SUMMARY OF THE INVENTION

It is an object of the present invention, at least in the preferred embodiments, to overcome or substantially ameliorate one or more of the disadvantages of the prior art.

According to a first aspect of the invention there is provided a heat exchanger including:

a housing extending between a first end and a second end;

a first housing opening and a second housing opening disposed proximate said first end;

a third housing opening and a fourth housing opening disposed proximate said second end;

a plurality of like channel members, each including a heat exchanging wall and a peripheral flange extending outwardly from the wall for maintaining the wall in a spaced apart configuration from a like wall of an adjacent like channel member, wherein each flange defines a first channel member opening and a second channel member opening, and said channel members are arranged within the housing such that each of the first channel member openings are in communication with either the first or the second housing opening and each of the second channel member openings are in communication with either the third or fourth housing opening, thereby defining a plurality of first fluid flow paths between the first and third housing openings and a separate plurality of second fluid flow paths between the second and fourth housing openings.

Preferably, the channel members are alternately stacked such that adjacent flow paths alternate between first flow paths and second flow paths.

Preferably each channel member is disposable within the housing in:

a first orientation wherein the first channel member opening is in communication with the first housing opening and the second channel opening is in communication with the third housing opening; or a second orientation wherein the first channel member opening is in communication with the second housing opening and the second channel member opening is in communication with the fourth housing opening.

According to a second aspect of the invention there is provided a heat exchanger including:

a housing extending between a first end and a second end;

a first housing opening and a second housing opening disposed proximate said first end;

a third housing opening and a fourth housing opening disposed proximate said second end; and a plurality of like channel members arranged within the housing to define a plurality of first fluid flow paths between the first and third housing openings and a separate plurality of second fluid flow paths between the second and fourth housing openings, said first and second flow paths presenting substantially equal fluid flow resistance.

Preferably the housing includes a top face, a bottom face and two opposed side faces joining the opposite edges of top face and the bottom face. In one embodiment, the first and fourth housing openings are respectively disposed in said first and second ends, the third housing opening is disposed in the bottom face adjacent the second end and the second housing opening is disposed in the top face adjacent the first end. In another embodiment the first and second housing openings are disposed in the first end and the third and fourth housing openings are disposed in the second end.

According to a third aspect of the invention there is provided a channel member for a heat exchanger, said channel member including a heat exchanging wall and a peripheral flange extending outwardly from the wall for maintaining the wall in a spaced apart configuration from a like wall of a like channel member, wherein the flange defines a first channel member opening and a second channel member opening such that a plurality of like channel members are stackable so as to define a plurality of separate flow paths between said first and second channel member openings.

Preferably, the wall is rectangular and includes two opposed broad sides and two opposed short sides joining the broad sides. In one embodiment the first channel member opening is disposed along one short side and the second channel member opening is disposed along one broad side and adjacent to the other short side. In another embodiment the first channel member opening is disposed on a short side and the second channel member opening is disposed on the opposite short side.

Preferably also, the flange includes a lip for facilitating the abutment of the channel member to an adjacent like channel member. Alternatively, the flange supports a second heat exchanging wall opposed to and spaced apart from the first.

In a preferred form, the channel member includes a plurality of spaced apart baffles for increasing the length of the flow paths. More preferably, the baffles are parallel and alternately extend from the respective broad sides of the wall. More preferably, each baffle is integrally formed with the like baffle of an adjacent channel member.

According to a fourth aspect of the invention there is provided a method of constructing a heat exchanger including the steps of:

forming a plurality of channel members, each having a heat exchanging wall and a peripheral flange extending outwardly from the wall for maintaining the wall in a spaced apart configuration from a like wall of an adjacent like channel member, wherein the flange defines a first channel member opening and a second channel member opening;

forming a housing extending between a first and a second end and having a first and a second housing opening disposed proximate said first end and a third and fourth housing opening disposed proximate said second end;

arranging said channel members within said housing such that each of the first channel member openings are in communication with either the first or second housing member opening, and each of the second channel member openings are in communication with either the third or fourth housing opening, thereby defining a plurality of first fluid flow paths between the first and third housing openings and a separate plurality of second fluid flow paths between the second and fourth housing openings.

Preferably, the housing is formed by stamping a housing blank from a planar sheet material and folding said housing blank to form a housing. Similarly, the channel members are preferably formed by stamping a channel blank from a planar sheet material and folding said housing blank to form a channel member.

According to another aspect of the invention there is provided a method of exchanging heat between a first fluid and a second fluid, said method including circulating said first and second fluids through a respective plurality of first and second fluid flow paths defined by a plurality of stacked like channel members, each channel member having a heat exchanging wall and a peripheral flange extending outwardly from the wall for maintaining the wall in a spaced apart configuration from a like wall of an adjacent like channel member, wherein the flange of each channel member defines a first channel member opening for receiving fluid and a second channel member opening for exhausting fluid and whereby adjacent flow paths alternate between first and second flow paths, thereby to promote heat exchange across said heat exchanging walls.

Preferably, the first and second flow paths present substantially equal fluid flow resistance.

BRIEF DESCRIPTION OF THE DRAWINGS

Preferred embodiments of the invention will now be described, by way of example only, with reference to the accompanying drawings in which.

DETAILED DESCRIPTION OF PREFERRED EMBODIMENTS

Figure 1:
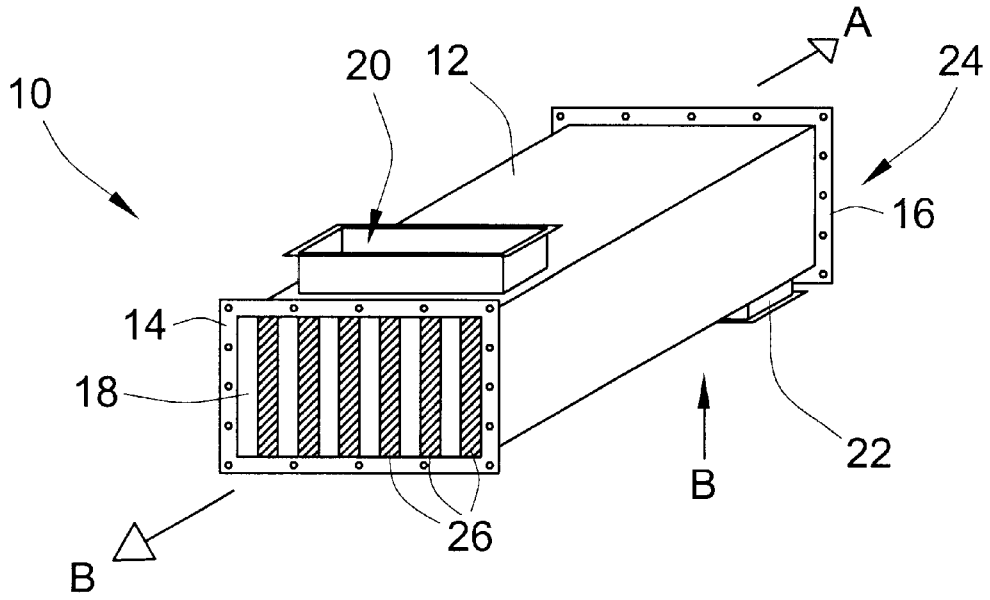
FIG. 1 is a perspective view of a heat exchanger according to an embodiment of the invention.

Referring to the drawings, the heat exchanger 10 includes a housing 12 extending between a first end 14 and a second end 16 and having a first housing opening 18 and a second opening 20 disposed proximate the first end 14. The housing 12 has a third housing opening 22 and a fourth housing opening 24 disposed proximate the second end 16.

Figure 3:
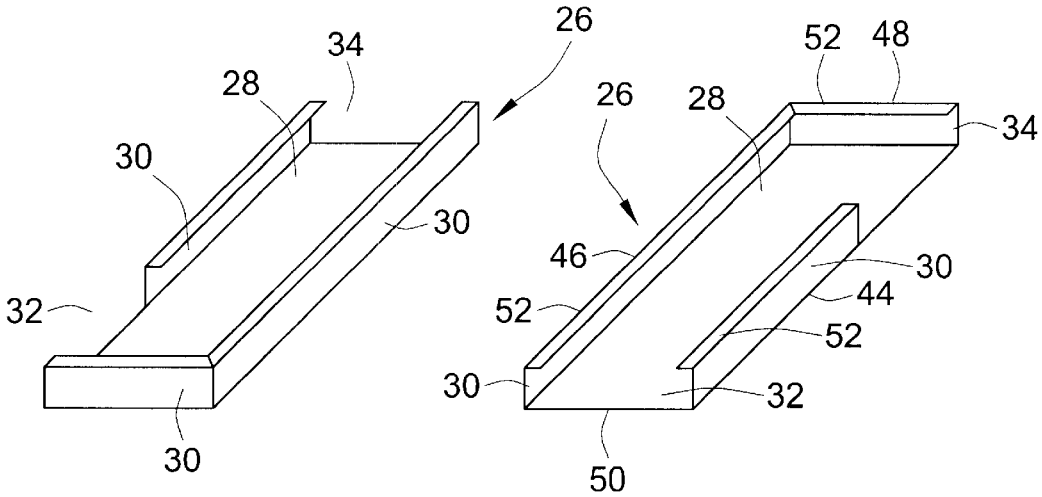
FIG. 3 is a perspective view of a pair of channel members according to an embodiment of the invention the invention, said channel members being adapted for arrangement within the heat exchanger of FIG. 1.
Figure 4:
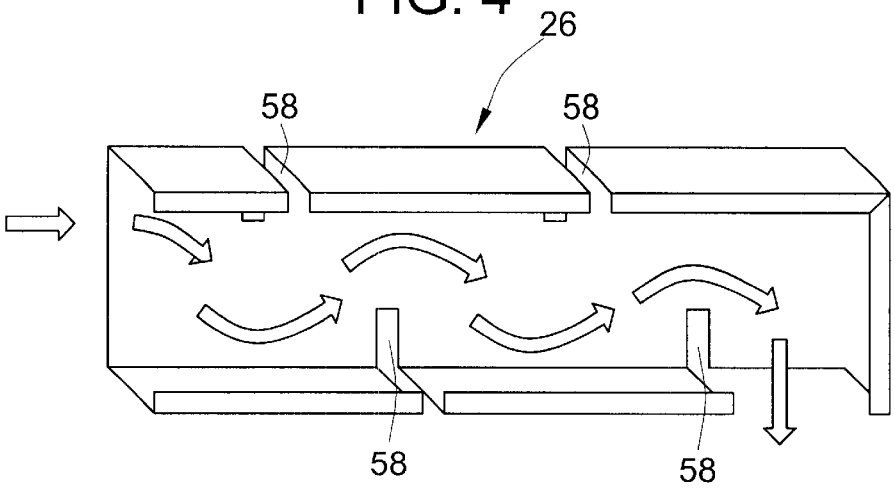
FIG. 4 is a perspective view of a channel member according to another embodiment of the invention, said channel member being adapted for arrangement within the heat exchanger of FIG. 1.

The heat exchanger 10 includes a plurality of like channel members 26, as can be seen for example in FIG. 3. Each channel member 26 includes a heat exchanging wall 28 and a peripheral flange 30. The peripheral flange extends outwardly from the wall 28 for maintaining the wall in a spaced apart configuration from a like wall of a like channel member. The flange 30 defines a first channel member opening 32 and a second channel member opening 34.

The channel members 26 are arranged within the housing 12 such that each of the first channel member openings 32 are in communication with either the first or the second housing opening 18 or 20. Each of the second channel member openings 34 are in communication with either the third or fourth housing opening 22 or 24. This arrangement defines a plurality of first fluid flow paths 36 between the first and third housing openings 18 and 22 and a separate plurality of second fluid flow paths 38 between the second and fourth housing openings 20 and 24. The first and second fluid flow paths 36 and 38 are depicted as dotted and solid arrows respectively.

The channel members 26 shown in FIG. 3 are alternately stacked such that adjacent flow paths alternate between first flow paths and second flow paths. For example, the two channel members shown in FIG. 3 are depicted as alternately oriented and are therefore ready for stacking next to each other for arrangement within a housing 12. In other words, the channel members 26 are disposable within the housing in one of the two orientations as shown in FIG. 3. In the first orientation the first channel member opening 32 is in communication with the first housing opening 18 and the second channel opening 34 is in communication with the third housing opening 22. In the second orientation the first channel opening member 32 is in communication with the second housing opening 20 and the second channel member opening 34 is in communication with the fourth housing opening 24. This arrangement advantageously allows an identical channel member 26 to be utilized in the construction of the heat exchanger 10 to provide two separate pluralities of flow paths between the various housing openings. The resultant modular design reduces manufacturing complexity.

In this embodiment all of the channel members are of like shape and are produced from sheet metal. In other embodiments not all of the channel members are produced from the same material.

Figure 2:
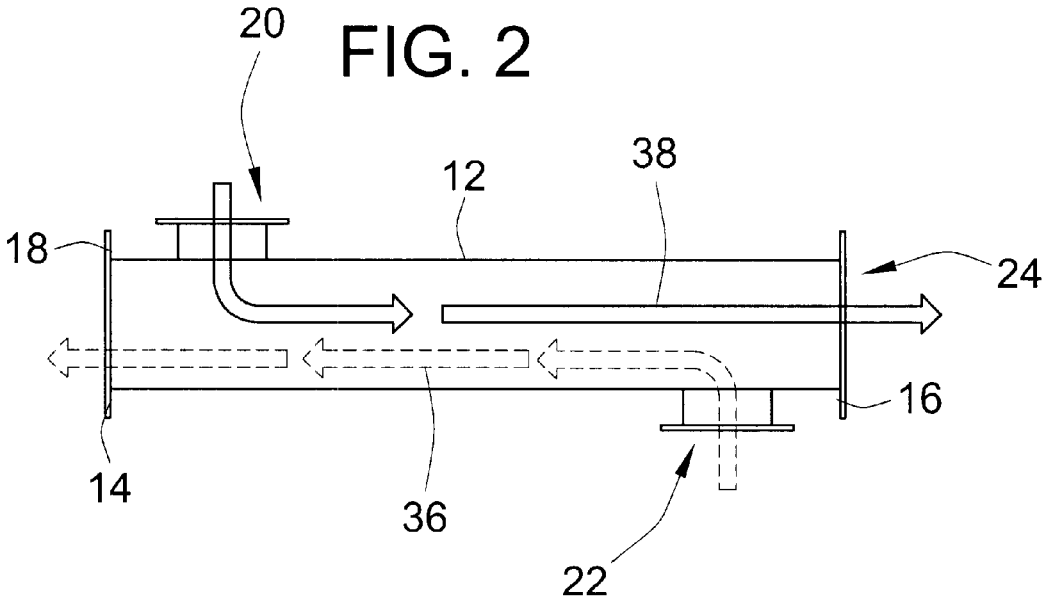
FIG. 2 is a side view of the heat exchanger of FIG. 1.
Figure 7:
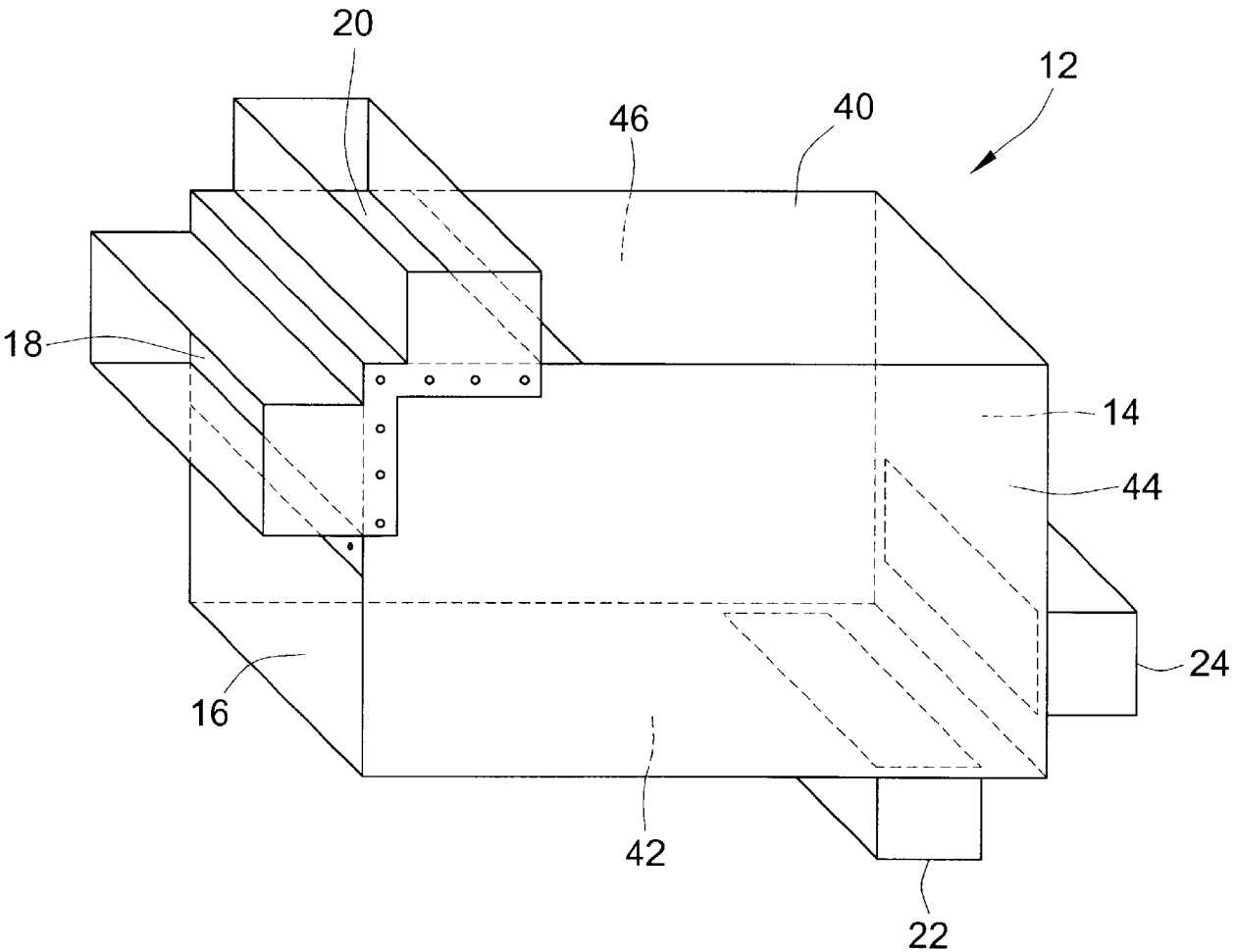
FIG. 7 is a perspective view of a housing according to one embodiment of the invention.

As can been seen from FIG. 2, the first fluid flow paths 36 present a substantially equal fluid flow resistance to that of the second fluid flow paths 38. This is achieved in the embodiment shown in FIG. 2 by forcing both fluid flow paths to traverse substantially the same total distance within the housing and to bend through substantially the same angle of deflection, being approximately 90°. A housing 12 suited to this arrangement is depicted in FIG. 7. The housing includes a top face 40, a bottom face 42 and two opposed side faces 44 and 46 joining the opposite edges of the top face 40 and the bottom face 42. The first and fourth housing openings 18 and 24 are respectively disposed in the first and second ends 14 and 16. The third housing opening 22 is disposed in the bottom face 42 adjacent the second end 14 and the second housing opening 20 is disposed in the top face 40 adjacent the first end 16.

As can be seen in FIG. 3, the channel members 26 include two opposed broad sides 44 and 46 and two opposed short sides 48 and 50 joining the broad sides. The first channel member opening 32 may be disposed along one short side 50 and the second channel member opening 34 may be disposed along one broad side 44 adjacent to the other short side 48. The flange 30 includes a lip 52 for facilitating the abutment of the channel member 26 to an adjacent like channel member. In alternative embodiments, not illustrated, the flange supports a second heat exchanging wall opposed to and spaced apart from the first heat exchanging wall. This arrangement is preferable for applications where sealing of the first flow paths from the second flow paths is paramount and it is acceptable to compromise the heat exchange efficiency for this purpose.

Figure 5:
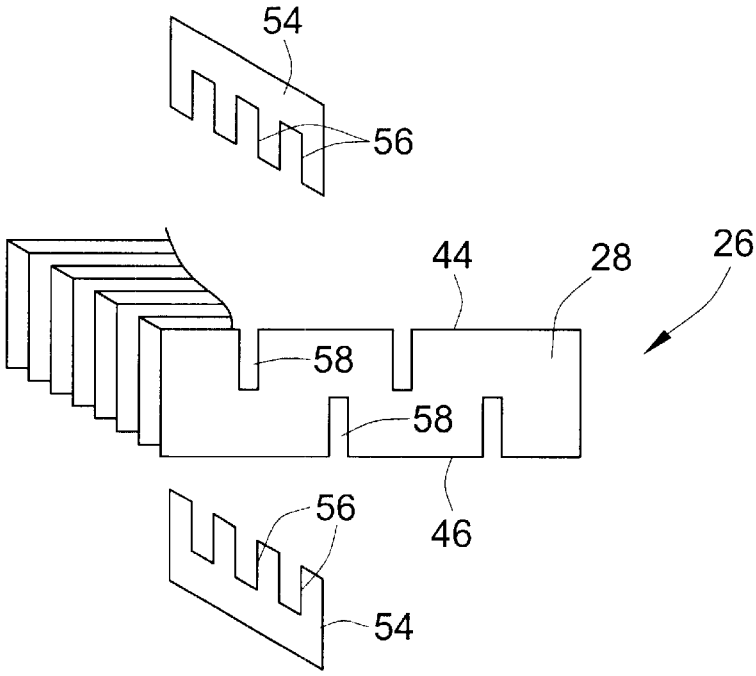
FIG. 5 is a perspective view of a plurality of channel members and baffles arranged for interengagement.
Figure 6:
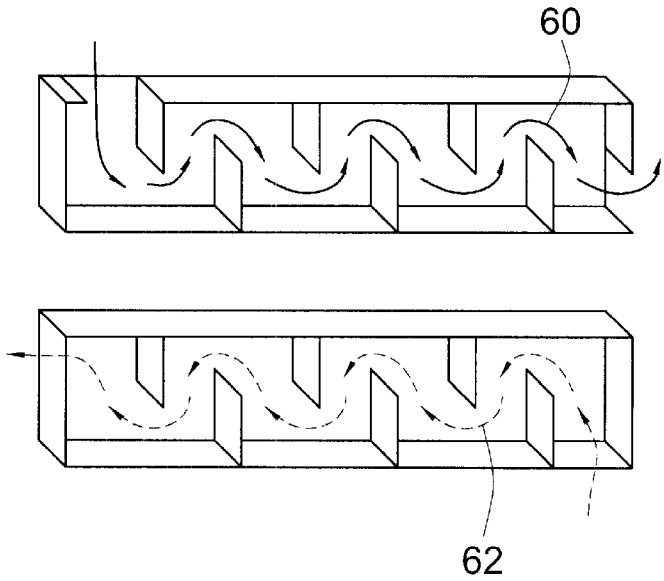
FIG. 6 is a perspective view of a pair of alternative embodiments of channel members including integral baffles.
Figure 8:
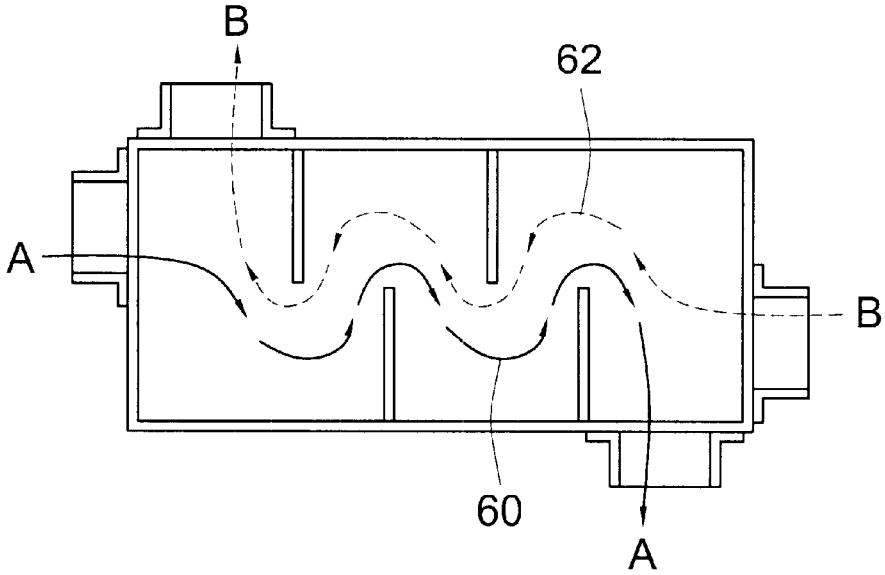
FIG. 8 is a cross sectional view of the heat exchanger of FIG. 1.

The heat exchanging efficiency may be improved by increasing the length of the first and second fluid flow paths 36 and 38. The most direct manner in which the length of the paths may be increased is to increase the separation between the first and second ends 14 and 16 of the housing 12. Alternatively if space constraints do not allow for a longer housing, a plurality of spaced apart baffles 54 may be disposed across the channel members 26. The baffles shown in FIG. 5 are parallel to each other and orthogonal to the channel members 26. The baffles 54 alternately extend from the respective broad sides 44 and 46 of the wall 28. Each baffle 54 is integrally formed with the like baffle of an adjacent channel member. Preferably the baffle 54 is formed from a sheet material and incorporates a number of slots corresponding to the number of channel members 26. The slots 56 of the baffle 54 are adapted to mate with corresponding slots 58 disposed in the channel member 26. Preferably the length of the slots 56 and 58 in the baffle 54 and the channel member 26 is approximately one quarter of the width of the channel member 26. Hence, once interlocked, the baffles provide alternate obstructions covering approximately half the width of the heat exchanger, thereby forcing the fluid travelling in either the first or the second fluid flow paths 36 or 38 to assume a lengthened curved path 60 and 62 as shown in FIG. 8.

Figure 9:
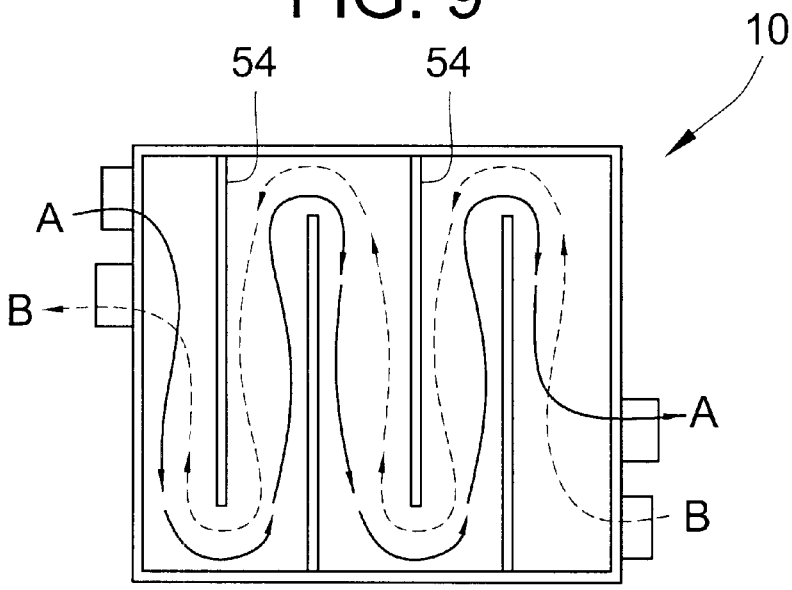
FIG. 9 is a cross sectional view of an alternative heat exchanger according to the invention.

FIG. 9 shows an alternative embodiment wherein the length of the flow paths has been increased by means of baffles 54 and also by means of increasing the height of the heat exchanger 10.

Figure 10:
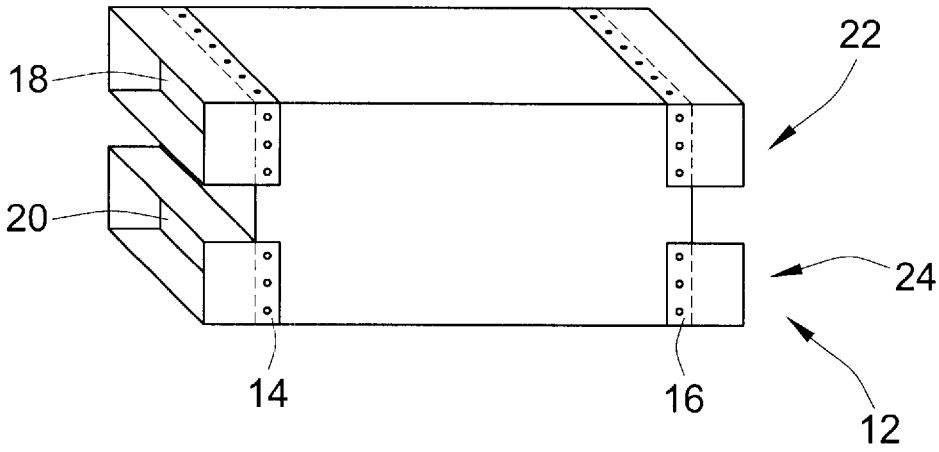
FIG. 10 is a perspective view of another embodiment of a heat exchanger according to the invention.
Figure 12:
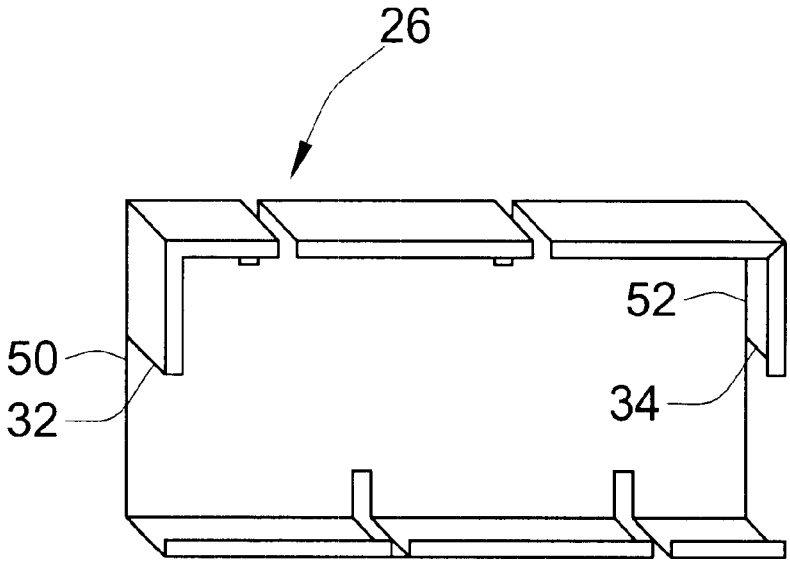
FIG. 12 is a perspective view of a channel member according to the invention, said channel member being adapted for arrangement within the heat exchanger of FIG. 10.

FIG. 10 shows an alternative embodiment of a housing 12 wherein the first and second housing openings 18 and 20 are disposed in the first end 14 and the third and fourth housing openings 22 and 24 are disposed in the second end 16. A channel member 26 is shown in FIG. 12 which is suitable for the housing 12 shown in FIG. 10. The first channel member opening 32 is disposed on short side 50 and the second channel member opening 34 is disposed on the opposite short side 52.

Figure 11:
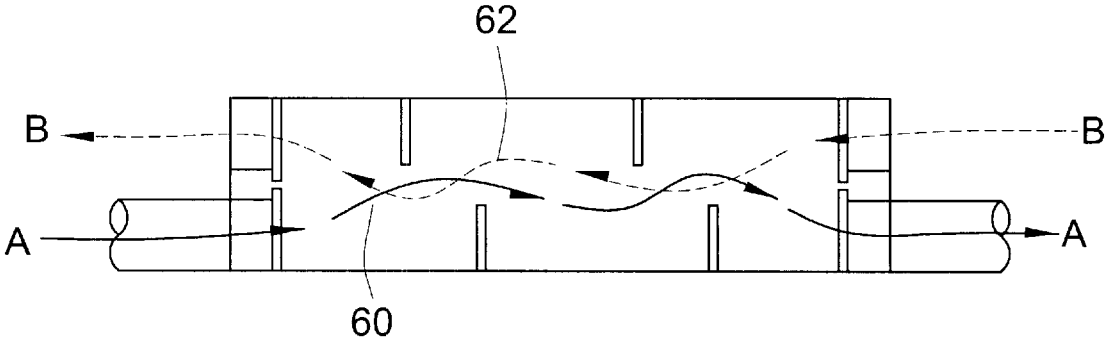
FIG. 11 is a cross sectional view of the heat exchanger of FIG. 10.

When a similar baffle arrangement to that described above is used in this embodiment of the heat exchanger, flow paths 60 and 62 are obtained as shown in FIG. 11. The fluid resistance of these paths is also matched in this embodiment as both paths feature substantially equal lengths and baffle obstructions.

The housing may be formed by stamping a housing blank (not illustrated) from a planar sheet material such as sheet metal. The housing blank is then folded to form the housing. When initially forming the housing, prior to the arrangement of the channel members within, the housing blank may be partially folded to provide a housing having a further opening sufficient for the ingress of a channel member. After passing the channel members through the further opening so as to arrange the channel members within the partially folded housing, the folding of the housing is completed by closing the further opening. In this manner the arranged channel members are retained within the housing.

Figure 13:
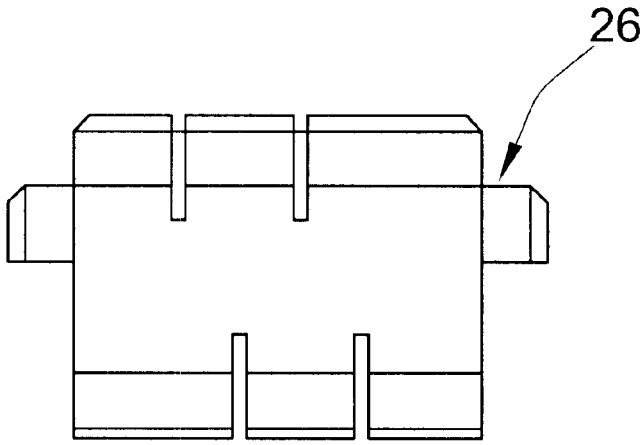
FIG. 13 is a plan view of a blank prior to forming into the channel member of FIG. 12.

FIG. 13 shows a blank design for a channel member 26 which can be folded along various fold lines to form the channel member 26 shown in FIG. 12. The blank design may be stamped from sheet metal, thereby allowing rapid and comparatively inexpensive production.

Figure 14:
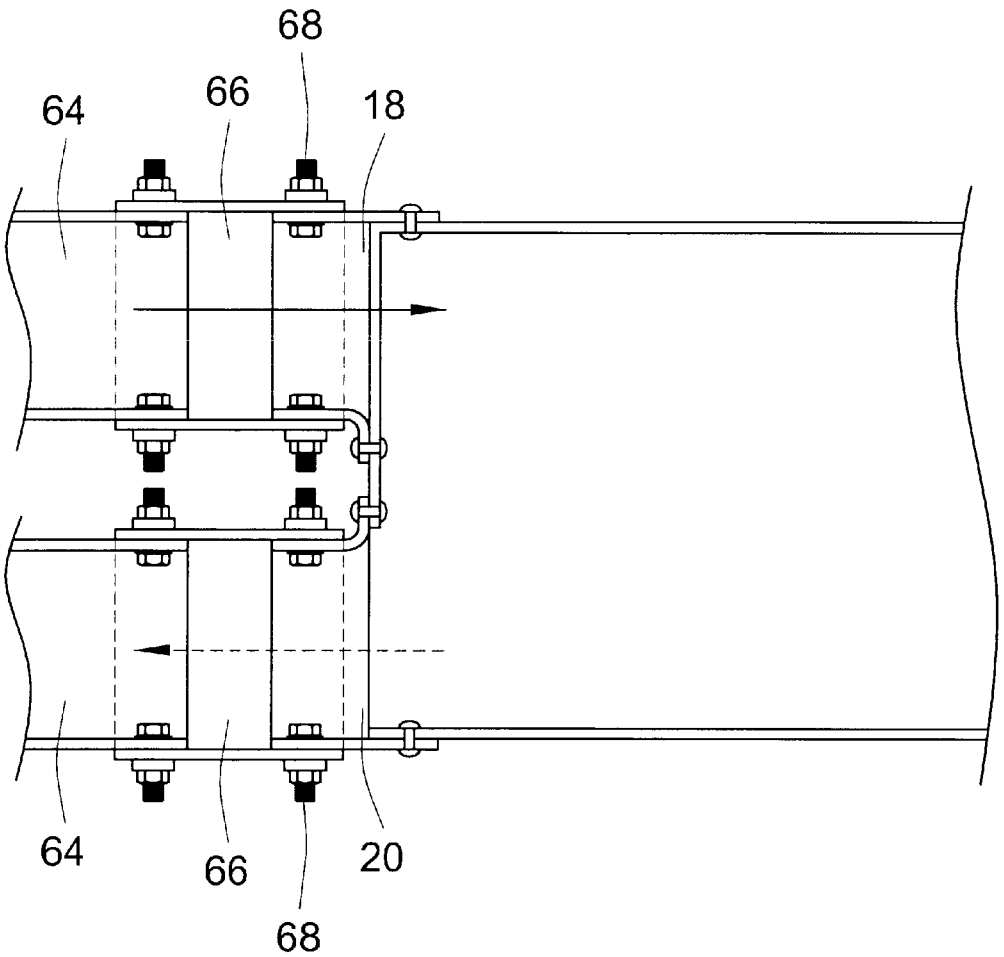
FIG. 14 is a side view showing connection of part of the heat exchanger of FIG. 10 to air conditioning ducting.

FIG. 14 shows a means by which ducting 64 may be attached to the first and second housing openings 18 and 20 by means of a flexible connection material 66 clamped into position by clamping means 68.

Figure 15:
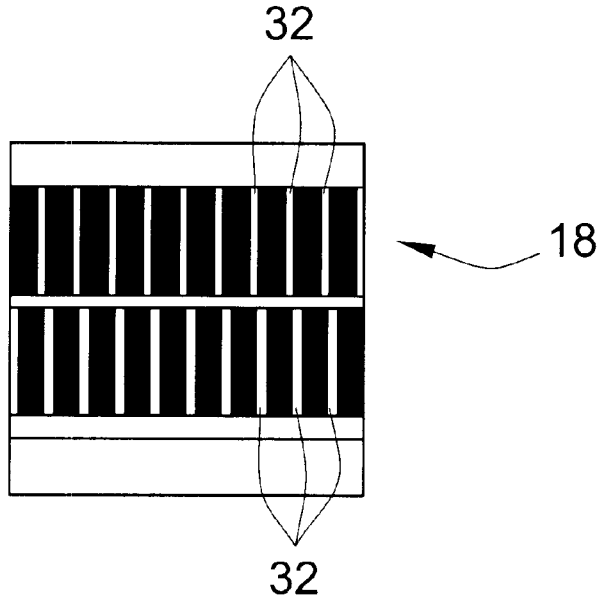
FIG. 15 is an end view of the heat exchanger shown in FIG. 10.

FIG. 15 shows an end view of the heat exchanger shown in FIG. 10 including alternately stacked channel members as shown in FIG. 12. The alternate stacking of the channel members results in the alternately disposed channel member openings 32 which communicate with the first and second housing openings 18 and 20.

Typical dimensions of the heat exchanger include a 35 millimetre separation between adjacent channel members, and length of approximately 2.3 metres between the first and second ends of the housing, a housing height of 500 millimetres, and a housing width of 700 millimetres. The height of the housing openings may be approximately 200 millimetres, which also corresponds to the height of the first and second channel member openings 32 and 34.

Figure 16:
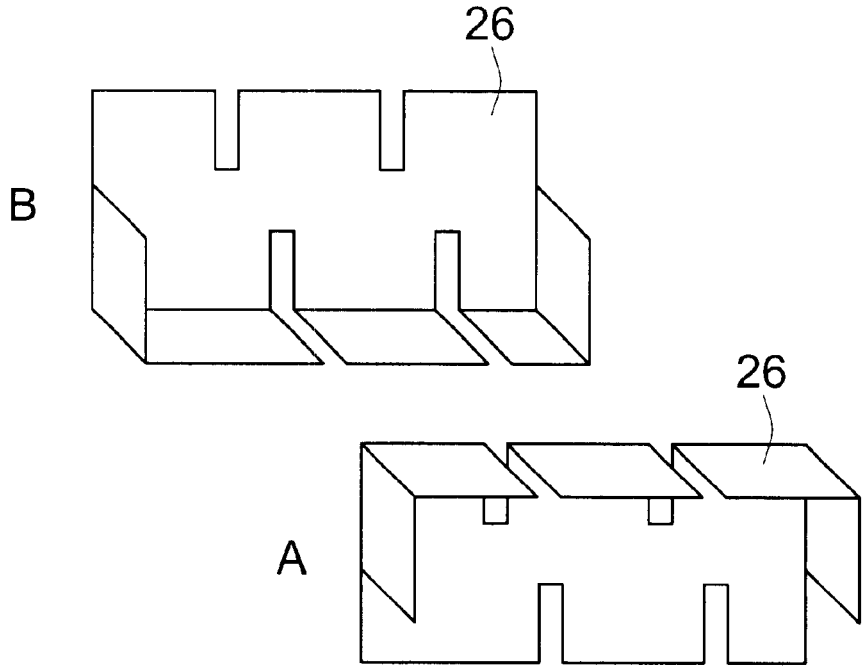
FIG. 16 is a perspective view of a pair of identical channel members in alternative orientations.

FIG. 16 shows the manner in which the channel members 26 suitable for the housing 12 shown in FIG. 10 may be alternately stacked. The two channel members 26 are shown in alternate orientation ready to be arranged next to each other.

Figure 17:
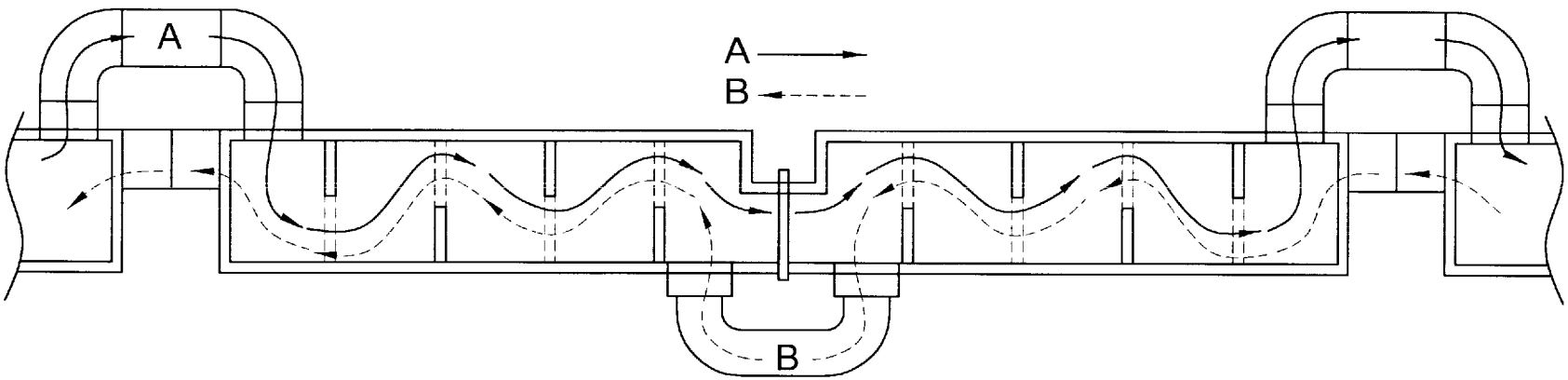
FIG. 17 is a cross sectional view of a plurality of interconnected heat exchanges according to the invention.

Greater heat exchanging capacity may be obtained by linking several heat exchanges in parallel, as depicted in FIG. 17.

In applications where the sealing of the first flow paths from the second flow paths is an important consideration, such as clean rooms, hospitals etc, the joints between the channel members 26 and the housing 12 may be sealed by a viscus adhesive sealant which may be applied during assembly. Additional sealing against such cross contamination may be obtained by means of a second heat exchanging wall disposed upon the flange parallel to the first heat exchanging wall 28. This arrangement requires heat to flow across two heat exchanging walls to exchange between a first and second flow path 36 and 38. Hence this double-walled design is suited to applications where sealing against cross contamination is a more important consideration than heat exchanging efficiency.

In numerous other applications the requirement to minimise or eradicate cross contamination between the flow paths will not be as stringent. For example, in many airconditioning systems approximately 30% of air is directly recirculated, with the result that the sealing of the flow paths is not a critical consideration. In such applications neither sealant nor double-walled channel members are required, rather close tolerances between the channel members 26 and the housing 12 can provide adequate sealing against cross contamination.

The channel members 26 may be fixed within the housing 12 by means not only of a viscus adhesive sealant, but also by other joining or sealing means such as continuous or spot welding, use of rivets, sealing gaskets and the like.

Figure 18:
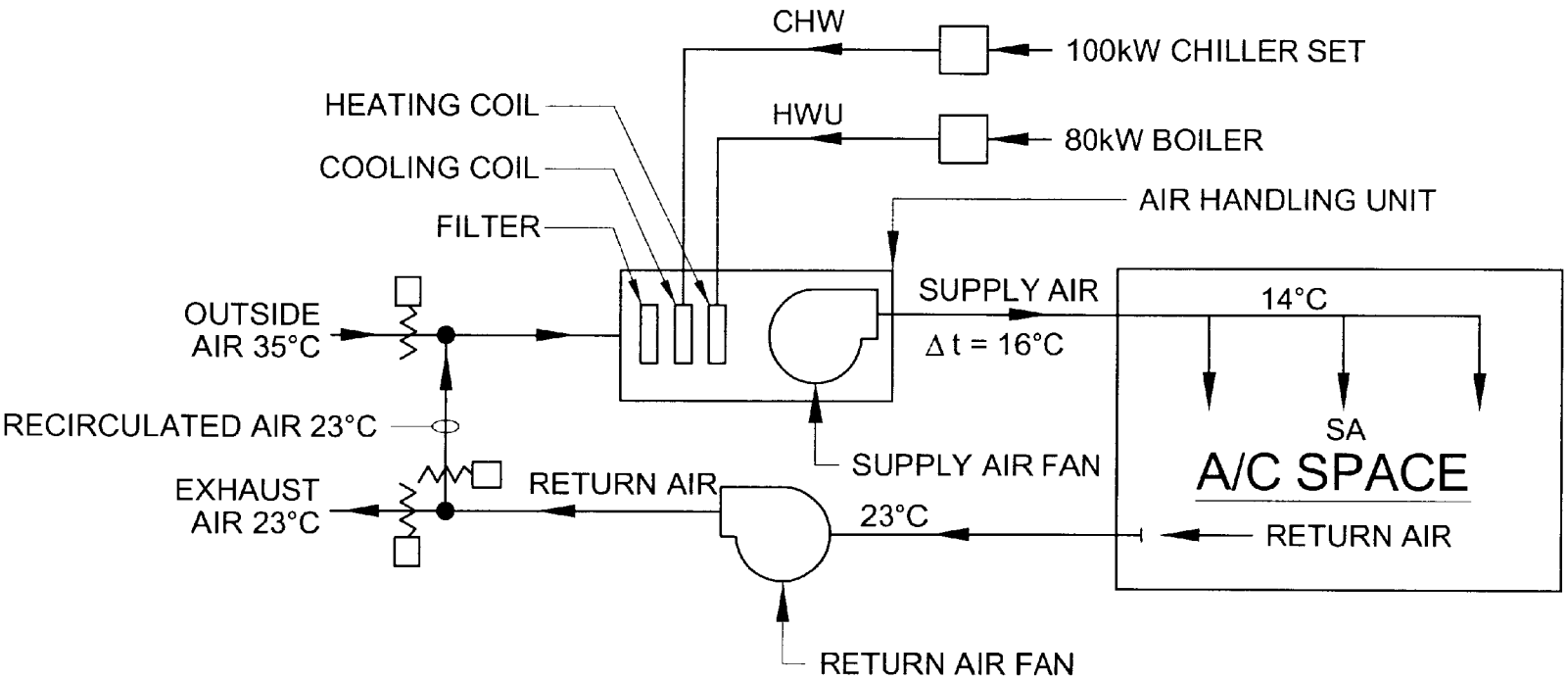
FIG. 18 is a schematic diagram representing a known airconditioning arrangement.
Figure 19:
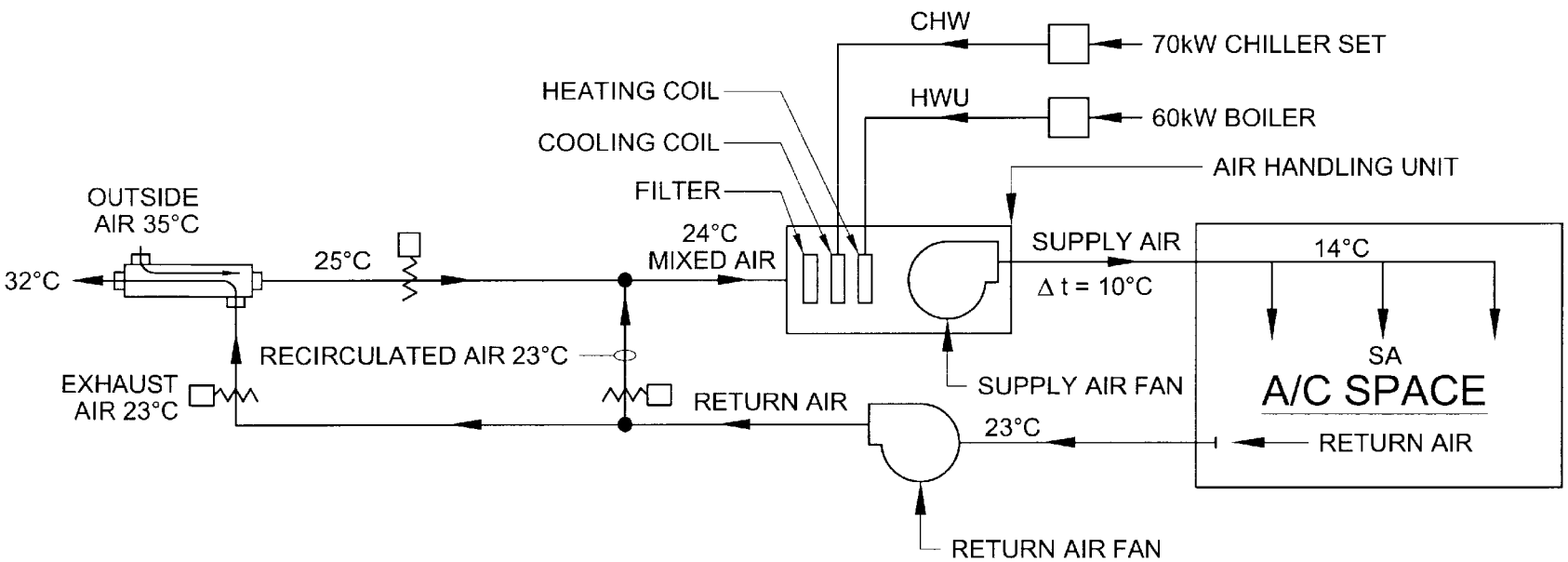
FIG. 19 is a schematic representation of the airconditioning arrangement of FIG. 18 with the addition of a heat exchanger according to the invention.
Figure 20:
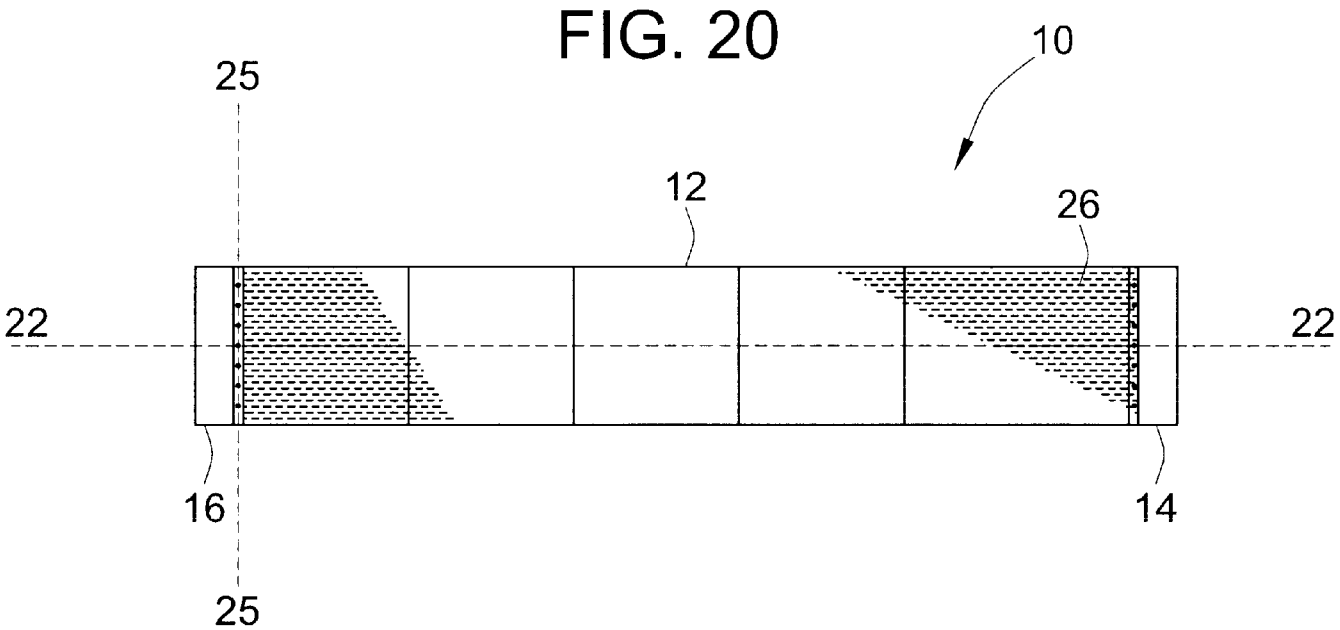
FIG. 20 is a cross sectional plan view of a alternative embodiment of a heat exchanger according to the invention.
Figure 21:
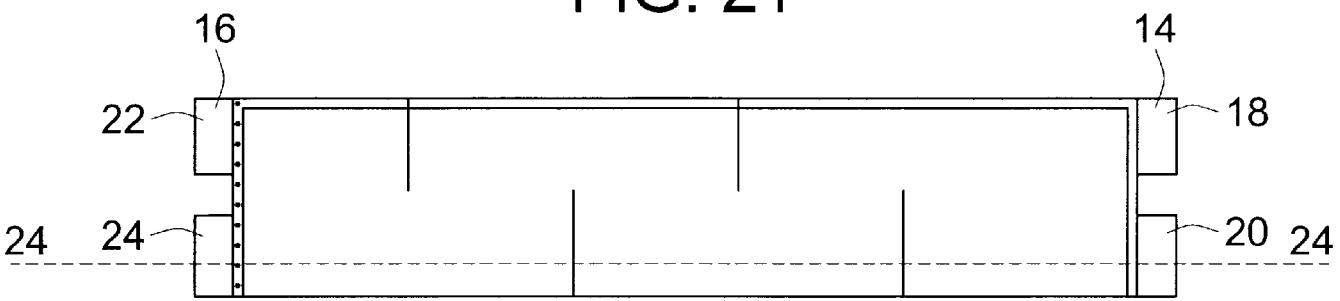
FIG. 21 is a cross sectional elevation view of a heat exchanger with baffles installed.
Figure 22:
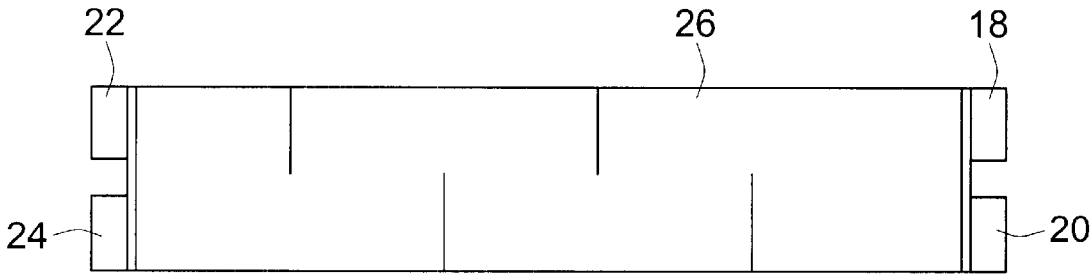
FIG. 22 is a cross sectional elevation view of the heat exchanger taken through line 22—22 of FIG. 20.
Figure 23:
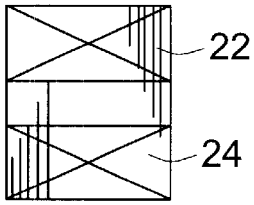
FIG. 23 is an end view of the heat exchanger shown in FIG. 20.
Figure 24:
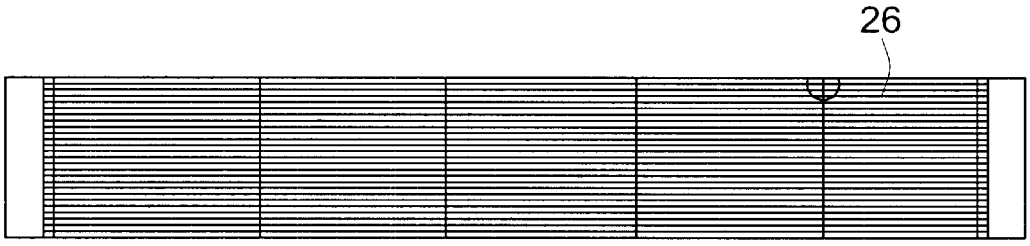
FIG. 24 is a cross sectional view of the heat exchanger of FIG. 21 taken through line 24—24.
Figure 25:
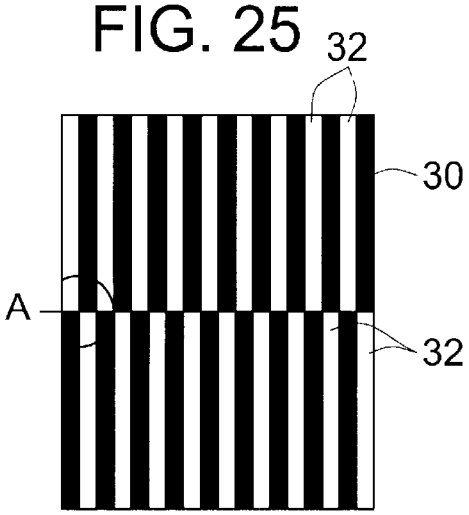
FIG. 25 is a cross sectional end view of a plurality of alternatively stacked channel members taken through line 25—25 of FIG. 20.
Figure 26:
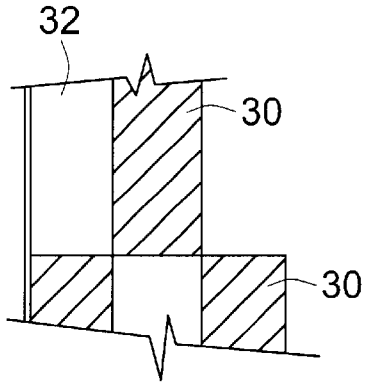
FIG. 26 is a detailed view of the region labelled "A" on FIG. 25.
Figure 27:
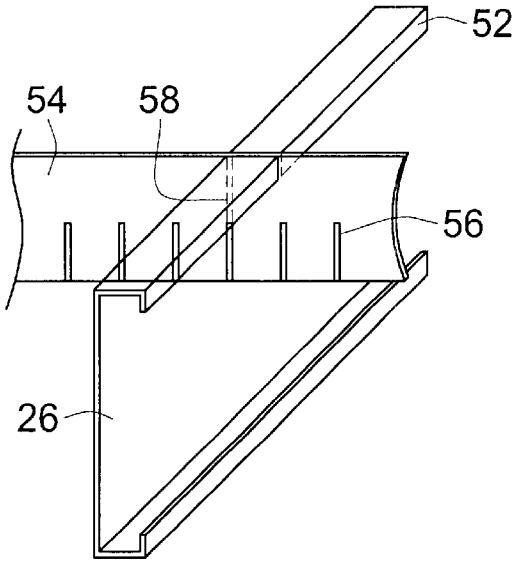
FIG. 27 is a perspective view of a channel member and baffle embodiment.
Figure 28:
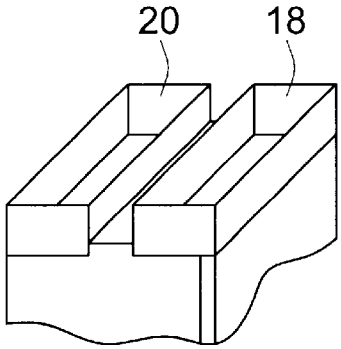
FIG. 28 is a perspective view of an end of a heat exchanger housing.
Figure 29:
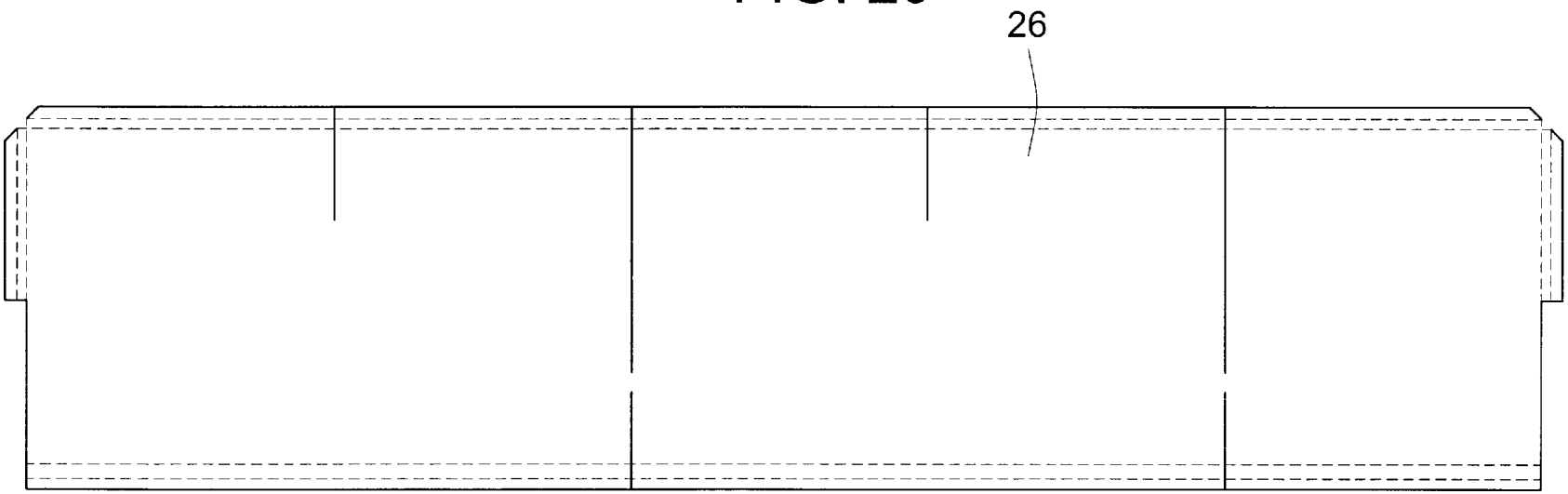
FIG. 29 is a plan view of a channel member blank.
Figure 30:
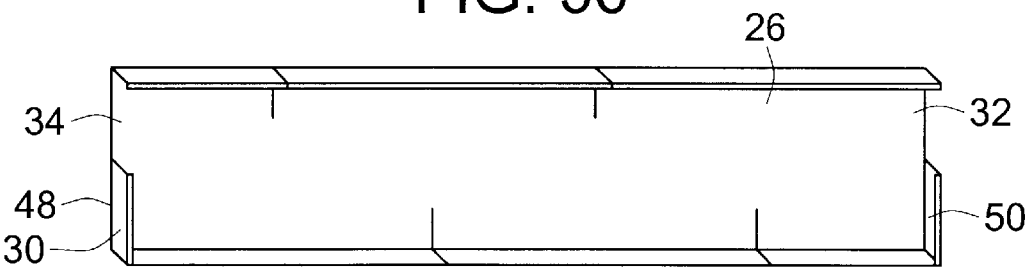
FIG. 30 is a perspective view of a channel member.
Figure 31:
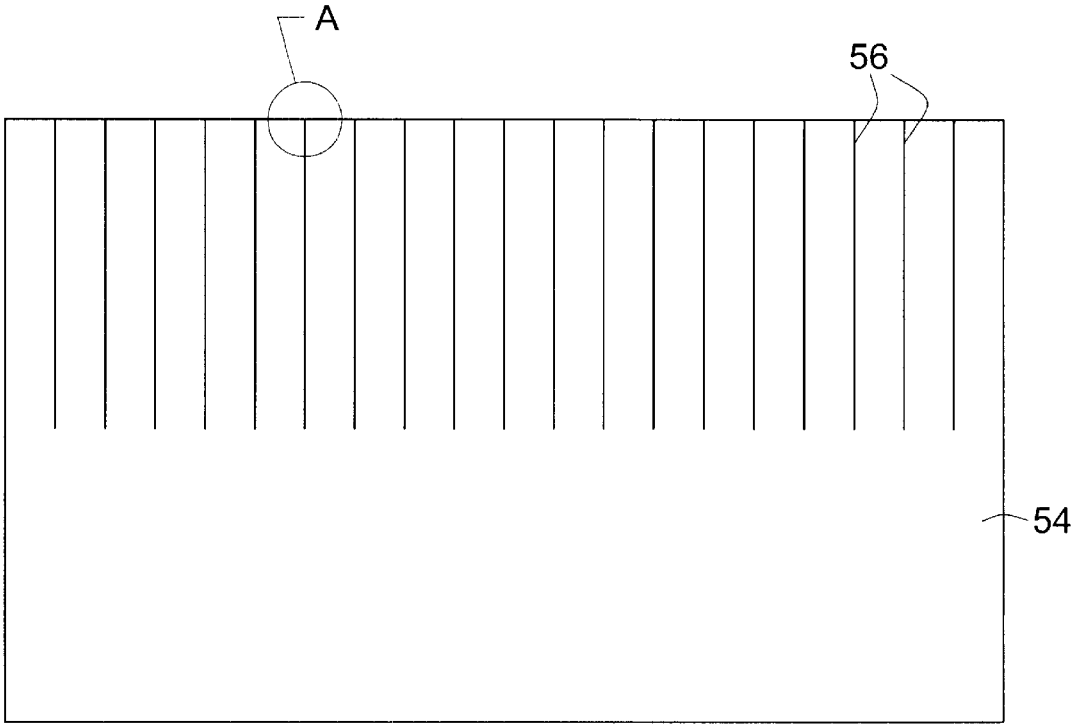
FIG. 31 is an elevational view of a baffle.
Figure 32:
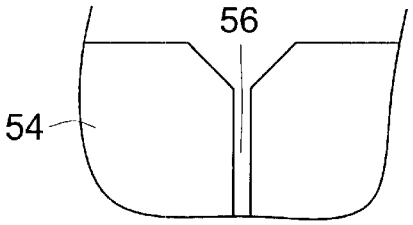
FIG. 32 is a detailed view of the region labelled "A" of FIG. 31.
Figure 33:
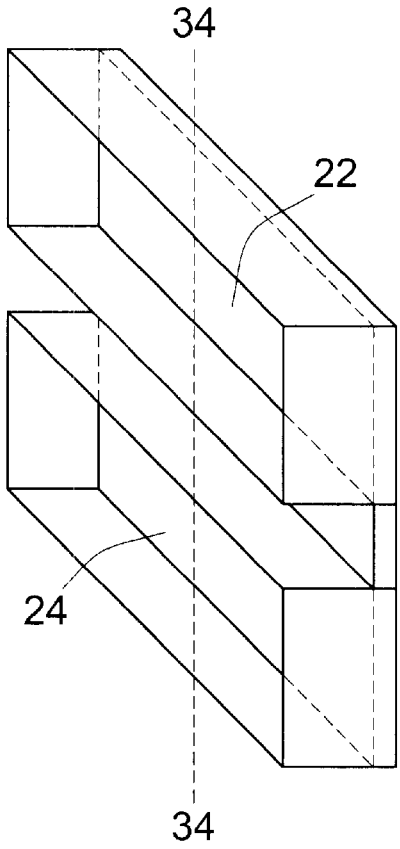
FIG. 33 is a perspective view of an end of the heat exchanger housing.
Figure 34:
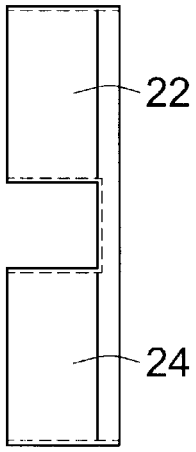
FIG. 34 is a cross sectional view of the end shown in FIG. 33 through line 34—34.
Figure 35:
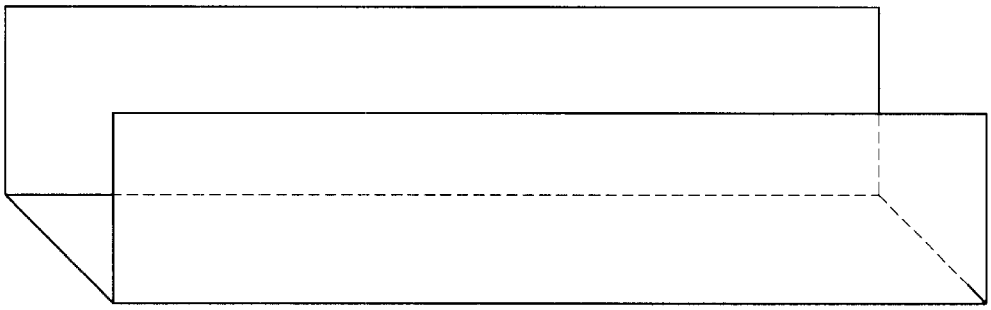
FIG. 35 is a perspective view of a casing adapted to line the interior of the heat exchanger housing.
Figure 36:
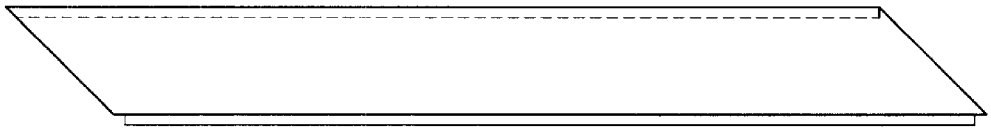
FIG. 36 is a lid for an embodiment of the heat exchanger body.

FIG. 18 is a schematic representation of a airconditioning system operating without a heat exchanger. FIG. 19 is a representation of a similar system wherein a heat exchanger 10 in accordance with the present invention has been installed. The main advantage of the heat exchanger is that exhaust air at a relatively cool temperature of 23° exchanges heat with the outside air which is at an initial temperature of 35° C. Due to the heat exchanging process, the outside air is then fed into the airconditioning system at a temperature of 25° C. This air is then mixed with a proportion of exhaust air, for example 30%, to yield a mixture of air having a temperature of 24° C. which is then cooled by the airconditioning system to a temperature of 14° C. involving a reduction in temperature of 10° C. This compares favourably with the arrangement shown in FIG. 18 wherein the airconditioning system is fed with an air mixture at an initial temperature of 30° C. which must then be cooled to a temperature of 14° C., involving a reduction in temperature of 16° C. This beneficial affect means that substantially identical airconditioning results can be obtained with the 70 kilowatt chiller set in the arrangement of FIG. 19, in comparison to the 100 kilowatt chiller set in the arrangement of FIG. 18.

The arrangement shown in FIG. 19 is a demonstration of a method of exchanging heat between two fluids to improve the efficiency of an air conditioning system. The method includes the steps of providing a heat exchanger as described above and circulating a first fluid, such as exhaust air at a comparatively lower temperature, through the first fluid flow paths and a second fluid, such as incoming fresh air at a comparatively higher temperature, through the second fluid flow paths to encourage heat exchange between the first and second fluids across the heat exchanging walls.

FIGS. 20 to 35 show alternative embodiments of heat exchangers and components therefore. In these figures the features are numbered so as to correspond with the feature numbering of FIGS. 1 to 19.

Although the invention has been described with reference to particular examples it will be appreciated by those skilled in the art that it may be embodied in many other forms.

What I claim is:

1. A heat exchanger including:

a housing extending between a first end and a second end;

a first housing opening and a second housing opening disposed proximate the first end;

a third housing opening and a fourth housing opening disposed proximate the second end;

a plurality of channel members, each channel member including slots and a heat exchanging wall and a peripheral flange extending outwardly from the heat exchanging wall for maintaining the heat exchanging wall in a spaced apart configuration from a heat exchanging wall of an adjacent channel member, wherein each flange defines a first channel member opening and a second channel member opening, and the channel members are arranged within the housing such that each of the first channel member openings are in communication with one of the first and second housing openings and each of the second channel member openings are in communication with one of the third and fourth housing openings, thereby defining a plurality of first fluid flow paths between the first and third housing openings and a separate plurality of second fluid flow paths between the second and fourth housing openings; and a plurality of spaced apart baffles increasing length of the first and second flow paths, the baffles including a plurality of slots corresponding to and mating with the slots in the channel members.

2. The heat exchanger according to claim 1 wherein the channel members are alternately stacked such that adjacent flow paths alternate between first flow paths and second flow paths.

3. The heat exchanger according to claim 1 wherein each channel member is disposable within the housing in:

a first orientation wherein the first channel member opening is in communication with the first housing opening and the second channel opening is in communication with the third housing opening; or a second orientation wherein the first channel member opening Is in communication with the second housing opening and the second channel member opening is in communication with the fourth housing opening.

4. The heat exchanger according to claim 1 wherein the first and second flow paths present substantially equal fluid flow resistances.

5. The heat exchanger according to claim 1 wherein the housing includes a top face, a bottom face, and two opposed side faces joining opposite edges of the top face and the bottom face.

6. The heat exchanger according to claim 5 wherein the first and fourth housing openings are respectively disposed in the first and second ends, the third housing opening is disposed in the bottom face adjacent the second end, and the second housing opening is disposed in the top face adjacent the first end.

7. The heat exchanger according to claim 5 wherein the first and second housing openings are disposed in the first end and the third and fourth housing openings are disposed in the second end.

8. The heat exchanger according to claim 1 wherein the plurality of slots in each baffle equals the plurality of channel members.

9. The heat exchanger according to claim 1 wherein the baffles are parallel to each other and orthogonal to the channel members.

10. The heat exchanger according to claim 1 wherein the baffles alternately extend from respective broad sides of the heat exchanging wall.

11. The heat exchanger according to claim 1 wherein each baffle is integral with the baffle of an adjacent channel member.

12. The heat exchanger according to claim 1 wherein the slots in the channel members and in the baffles are approximately one-quarter of the channel member width.

13. A channel member for a heat exchanger, said channel member including slots, a heat exchanging wall, and a peripheral flange extending outwardly from the wall for maintaining the wall in a spaced apart configuration from a heat exchanging wall of another channel member, wherein the peripheral flange defines a first channel member opening and a second channel member opening such that a plurality of the channel members are stackable to define a plurality of separate flow paths between the first and second channel member openings, the slots in the channel member mating with corresponding slots disposed in baffles.

14. The channel member for a heat exchanger according to claim 13 wherein the heat exchanging wall is rectangular and includes opposed first and second broad sides and opposed first and second short sides joining the broad sides.

15. The channel member for a heat exchanger according to claim 14 wherein the first channel member opening is disposed along the first short side and the second channel member opening is disposed along the first broad side and adjacent to the second short side.

16. The channel member for a heat exchanger according to claim 14 wherein the first channel member opening is disposed on the first short side and the second channel member opening is disposed on the second short side.

17. The channel member for a heat exchanger according to claim 13 where in the peripheral flange includes a lip for facilitating abutment of the channel member to an adjacent channel member.

18. A method of constructing a heat exchanger including:

forming a plurality of channel members, each channel member having a plurality of slots, a heat exchanging wall, and a peripheral flange extending outwardly from the heat exchanging wall for maintaining the heat exchanging wall in a spaced apart configuration from a heat exchanging wall of an adjacent channel member, wherein the flange defines a first channel member opening and a second channel member opening;

forming a housing extending between a first end and a second end and having first and second housing openings disposed proximate the first end and third and fourth housing openings disposed proximate the second end;

forming a plurality of baffles, each baffle including baffle slots for mating with the slots in the channel members;

arranging the channel members within the housing such that each of the first channel member openings is in communication with one of the first and second housing member openings, and each of the second channel member openings is in communication with one of the third and fourth housing openings, thereby defining a plurality of first fluid flow paths between the first and third housing openings and a separate plurality of second fluid flow paths between the second and fourth housing openings; and mating the baffle slots with the channel member slots.

19. The method of constructing a heat exchanger according to claim 18 wherein the housing is formed by stamping a housing blank from a planar sheet material and folding the housing blank to form the housing.

20. The method of constructing a heat exchanger according to claim 18 wherein the channel members are formed by stamping a channel blank from a planar sheet material and folding the housing blank to form the channel member.

21. A method of exchanging heat between a first fluid and a second fluid, the method including respectively circulating the first and second fluids through a respective plurality of first and second fluid flow paths defined by a plurality of stacked channel members, wherein adjacent flow paths alternate between the first and second flow paths to promote heat exchange across the heat exchanging walls, and each channel member includes slots, a heat exchanging wall, and a peripheral flange extending outwardly from the wall for maintaining the wall in a spaced apart configuration from a heat exchanging wall of another channel member, wherein the peripheral flange defines a first channel member opening and a second channel member opening such that the plurality of stacked channel members define a plurality of separate flow paths between the first and second channel member openings, the slots in the channel member mating with corresponding slots disposed in baffles.

22. The method of exchanging heat between a first fluid and a second fluid according to claim 21 wherein the first and second flow paths present substantially equal fluid flow resistance.

* * * * *